US008136677B2

(12) United States Patent
Brozak et al.

(10) Patent No.: US 8,136,677 B2
(45) Date of Patent: Mar. 20, 2012

(54) ADJUSTABLE GREETING CARD POCKET

(75) Inventors: Emory N. Brozak, Strongville, OH (US); Anthony J. Santarelli, North Olmsted, OH (US)

(73) Assignee: American Greetings Corp., Cleveland, OH (US)

( * ) Notice: Subject to any disclaimer, the term of this patent is extended or adjusted under 35 U.S.C. 154(b) by 365 days.

(21) Appl. No.: 12/628,394

(22) Filed: Dec. 1, 2009

(65) Prior Publication Data

US 2011/0126436 A1 Jun. 2, 2011

(51) Int. Cl.
*A47F 7/14* (2006.01)

(52) U.S. Cl. ..... 211/50

(58) Field of Classification Search ..... 211/50, 211/52, 55, 175, 184, 88.02, 88.01, 128.1
See application file for complete search history.

(56) References Cited

U.S. PATENT DOCUMENTS

| | | | | | |
|---|---|---|---|---|---|
| 1,515,058 | A | * | 11/1924 | Lindhe | 211/50 |
| 2,513,474 | A | * | 7/1950 | Greer | 211/50 |
| 3,129,819 | A | * | 4/1964 | Chandler | 211/50 |
| 4,003,470 | A | * | 1/1977 | Lagorio et al. | 211/50 |
| 4,079,841 | A | * | 3/1978 | Castel | 211/131.1 |
| 4,819,792 | A | | 4/1989 | Christian | |
| 4,874,099 | A | * | 10/1989 | Arnott et al. | 211/50 |
| 4,938,365 | A | * | 7/1990 | Conway et al. | 211/50 |
| 5,050,747 | A | * | 9/1991 | Krautsack | 211/50 |
| 5,184,737 | A | * | 2/1993 | Hardy | 211/55 |
| 5,222,609 | A | * | 6/1993 | Eaton | 211/55 |
| 5,301,800 | A | | 4/1994 | Kenney | |
| 5,322,167 | A | | 6/1994 | Birutis et al. | |
| 5,328,037 | A | * | 7/1994 | Fujii | 211/55 |
| 5,938,048 | A | * | 8/1999 | Carroll et al. | 211/55 |
| 6,098,818 | A | * | 8/2000 | Ali et al. | 211/50 |
| 6,405,879 | B1 | | 6/2002 | Fox | |
| 6,427,853 | B2 | * | 8/2002 | Brozak, Jr. | 211/55 |
| 6,454,106 | B1 | | 9/2002 | Howard | |
| 6,533,118 | B1 | | 3/2003 | Nelson | |
| 6,651,827 | B1 | | 11/2003 | Eberwein et al. | |
| 6,705,473 | B1 | | 3/2004 | Schlesinger | |
| 6,929,117 | B1 | | 8/2005 | Cohen | |
| 6,968,959 | B1 | | 11/2005 | Garvin | |
| 7,775,379 | B2 | * | 8/2010 | Hodge | 211/55 |
| 7,909,182 | B2 | * | 3/2011 | Maier-Hunke | 211/55 |
| 7,987,998 | B1 | * | 8/2011 | Belk et al. | 211/55 |
| 2004/0140276 | A1 | * | 7/2004 | Waldron | 211/51 |
| 2005/0224431 | A1 | * | 10/2005 | Campello et al. | 211/52 |

* cited by examiner

*Primary Examiner* — Sarah Purol
(74) *Attorney, Agent, or Firm* — Roetzel & Andress

(57) ABSTRACT

An adjustable card pocket having a back panel for attachment to a shelf or a mating panel and two half card pockets that are operatively attached to the back panel for holding and displaying greeting cards of varying width dimensions. The back panel contains four pocket engagement slots to engage the two pocket engagement tabs on each half card pocket. The back panel further contains a six adjustment slots designed to receive the one adjustment tab located on each of the half card pockets. The adjustment tabs can be inserted into one of three adjustment slots located on each side of the back panel allowing the pocket to contain cards of different width dimensions. The width of the pocket can be adjusted by applying a slightly outward force to each half card pocket to disengage the adjustment tabs from the adjustment slots and then slidably moving the half card pockets in either an inward or outward direction and re-engaging the adjustment tabs with another set of adjustment slots. The adjustable card pocket may be connected to a mating panel or other greeting card display device by engagement means located at the top and bottom of the back panel.

24 Claims, 4 Drawing Sheets

ADJUSTABLE GREETING CARD POCKET

RELATED APPLICATIONS

There are no applications related to this application.

FIELD OF THE INVENTION

The present invention pertains generally to fixtures for the retail display and sale of greeting cards, and more specifically to an adjustable pocket used to hold and display greeting cards and envelopes.

BACKGROUND OF THE INVENTION

Greeting card displays in retail stores have taken many forms designed to neatly present a wide variety of cards in a compact arrangement. Common features of such displays are successive rows of card shelves, tiered or vertical, with dividers on each shelf which define card pockets. The shelves are attached to and supported by a back panel which is supported upon a vertically oriented frame. The frame may include two spaced-apart upright members with multiple attachment points, and an upright member is attached to span between the upright members. The dividers may be also attached to the back panel, or to the shelves. In some displays, the shelves and dividers may be rigidly attached to a back panel by fasteners, so that any assembly or adjustment of the display requires removal and re-attachment of such fasteners. Also, the spacing of the shelves and dividers is constant, so there is little or no flexibility to accommodate cards of different sizes on the same display.

SUMMARY OF THE INVENTION

The adjustable greeting card pocket of the present invention contains a back panel having at least two upper shelf engagement tabs; at least two lower shelf engagement tabs; at least four pocket engagement slots; at least six adjustment slots; and a release opening. The back panel is mechanically connected to two half card pockets. The left and right card pockets having a back wall; a front wall; a side wall; a floor; at least two pocket engagement tabs for mechanical and slidable engagement with two of the at least four pocket engagement slots of the back panel; and an adjustment tab for mechanical engagement with one of the at least six adjustment slots of the back panel. The back panel and the right and left half card pockets combine to form an adjustable-width card pocket for holding and displaying greeting cards in a retail environment. Several adjustable greeting card pockets may be mechanically attached to a mating panel that is part of, for example, a card spinner display device.

DETAILED DESCRIPTION OF PREFERRED AND ALTERNATE EMBODIMENTS

The adjustable greeting card pocket (hereinafter referred to as "the pocket") of the present disclosure and related inventions is shown in an exploded view in FIG. 1. The pocket includes three main assembly pieces: a back panel 10, and right 12R and left 12L half card pockets that are separately and mechanically engaged with the back panel 10.

Figure 1:
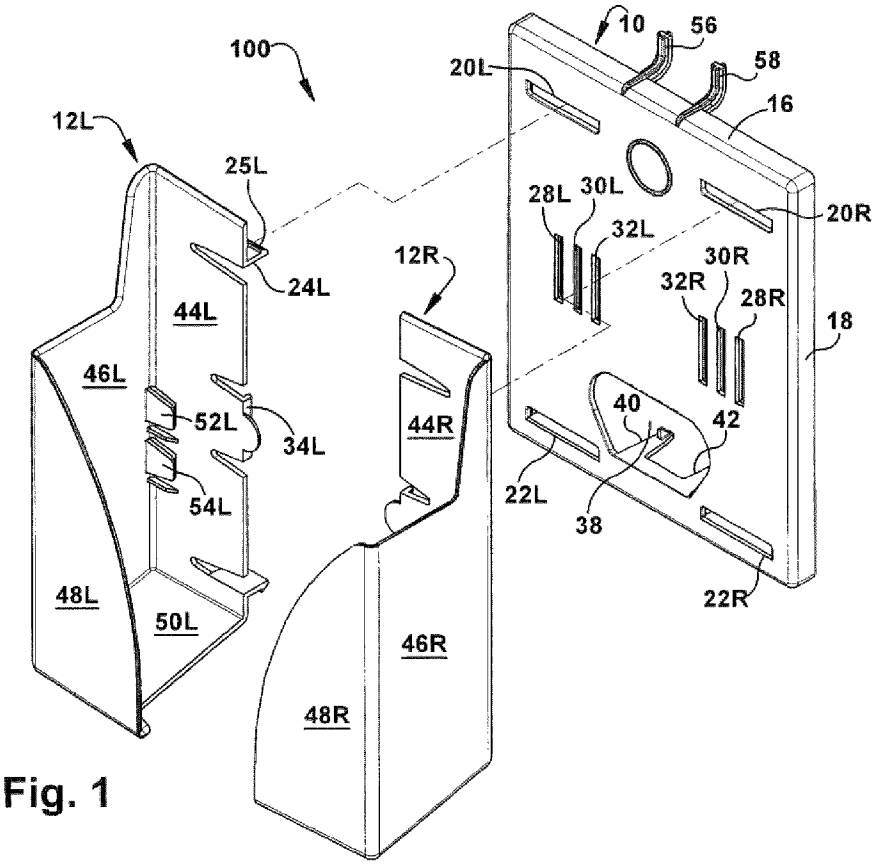
FIG. 1 is an exploded view of the adjustable card pocket of the present invention.

As shown in FIG. 1, the back panel is rectangular shaped and includes a front side 14, a back side (not shown), a top side 16, a bottom side (not shown), a right side 18 and a left side (not shown). The top 16, bottom, left and right 18 sides extend outward approximately 0.4 inches from the front side 14 of the back panel 10 in a backwards direction, creating a channel along the edges of the back side of the back panel 10. In a preferred embodiment, the back panel 10 is approximately 5.25 inches wide and 6.5 inches long. The back panel 10 contains a top right pocket engagement slot 20R, a bottom right pocket engagement slot 22R, a top left pocket engagement slot 20L and a bottom left pocket engagement slot 22L, that are approximately 1.311 inches wide and that correspond to the top right pocket engagement tab (not shown) and bottom right pocket engagement tab (not shown) located on the right half card pocket 12R and to the top left pocket engagement tab 24L and the bottom left pocket engagement tab 26L located on the left half card pocket 12L. The top right pocket engagement slot 20R and the top left pocket engagement slot 20L contain a small lip 70R, 70L that extends in a backwards direction from the top of the slots into the channel located on the back side of the back panel 10. The bottom right pocket engagement slot 22R and the bottom left pocket engagement slot 22L also contain a small lip 72R, 72L that extends in a backwards direction from the bottom of the slot into the channel located on the back side of the back panel 10. These lips are used to engage the pocket engagement tabs located on both the right and left card pockets. Each horizontal pocket engagement slot is located proximate to a corner of the back panel 10. The back panel 10 further includes six vertical adjustment slots 28R, 30R, 32R, 28L, 30L, 32L that correspond to adjustment tabs 34R, 34L located on each of the right 12R and left 12L half card pockets. The vertical adjustment slots 28R, 30R, 32R, 28L, 30L, 32L of the back panel 10 are grouped into two groups of three slots, a first group located proximate to the vertical center on the left side of the back panel 10 and a second group located proximate to the vertical center on the right side of the back panel 10.

Optionally, the back panel 10 may also contain a circular ridge 36 located at top center of the back panel 10 between the upper right pocket engagement slot 20R and the upper left pocket engagement slot 20L. The circular ridge 36 is used as a locator within which a round color-coded decal can be applied to indicate a category of greeting cards which should be installed within the pocket.

To facilitate engagement and removal of the adjustable card pocket with a mating panel, there is a release opening 38 located at the center of the lower portion of the back panel 10. The release opening 38 is an irregularly shaped cut-out and it is specifically located between the bottom right pocket engagement slot 22R and the bottom left pocket engagement slot 22L approximately ½ inch above the bottom edge of the back panel 10. Two lower panel engagement tabs 40, 42 are located at the base of the release opening 38, extending outward and away from the pocket 100 in a horizontal direction.

The lower panel engagement tabs 40, 42 contain arrowhead-like tips at the ends designed to engage the pocket 100 to holes within a mating panel. The release opening 38 allows for finger or thumb access through the back panel 10 to deflect the two lower panel engagement tabs 40, 42, allowing the arrowhead-like features to be disengaged from a mating panel. This allows for easy removal or re-positioning of the pocket 100 from a mating panel.

Figure 3:
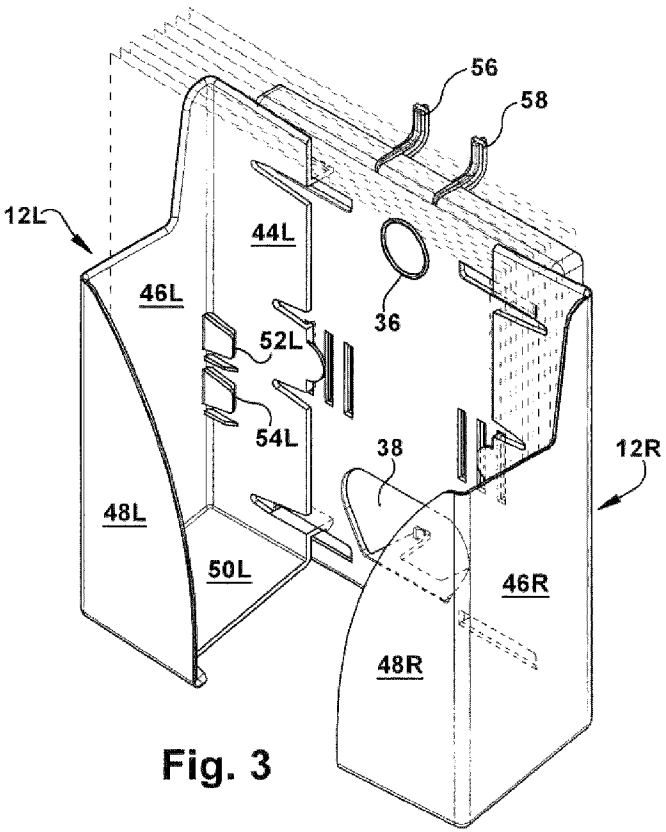
FIG. 3 is a perspective view of the adjustable card pocket of FIG. 1 in a third position or maximum width position.
Figure 2:
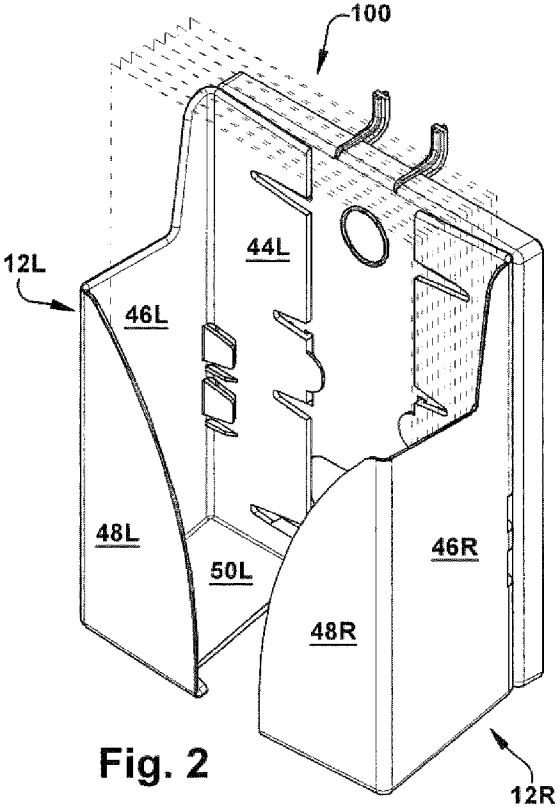
FIG. 2 is a perspective view of the adjustable card pocket of FIG. 1 in a first or minimum width position.

The right 12R and left 12R half card pockets mechanically engage with the back panel 10 to form the adjustable card pocket 100 of the present invention. As shown in FIG. 1, and as discussed above, each half card pocket contains a back wall 44R, 44L, a side wall 46R, 46L, a front wall 48R, 48L and a floor 50L. The side walls 46R, 46L extend between the back 44R, 44L and front 48R, 48L walls and, in a preferred embodiment, are approximately 2.285 inches wide. The floor 50L of the half card pockets is angled slightly downward, the angle between the back panels and floor is, in a preferred embodiment, being approximately 103 degrees. The subtle angle allows the greeting cards placed into the pocket to be situated in a slightly tiered position. The half card pockets 12R, 12L further include a top pocket engagement tab 24L and a bottom pocket engagement tab 26L that are inserted into and are slidably engaged with the top right and top left pocket engagement slots 20R, 20L and the bottom right and left pocket engagement slots 22R, 22L. The left and right top pocket engagement tabs contain an upward facing lip 25L that is used to engage the tabs with the lip 70R, 70L extending outward from the top of the left and right top pocket engagement slots contained on the back panel 10. The left and right bottom pocket engagement tabs contain a downward facing lip 26L that is used to engage the tabs with the lip 72R, 72L that extends outward from the bottom of the left and right top pocket engagement slots contained on the back panel 10. The half card pockets 12R, 12L are further engaged with the back panel 10 via the adjustment tabs 34R, 34L that are located generally at the vertical center of the half pockets 12R, 12L. The adjustment slots 28R, 30R, 32R, 28L, 30L, 32L and adjustment tabs 34R, 34L enable the card pocket 100 to have an adjustable width dimension. For example, as shown in FIG. 2, when the adjustment tabs 34R, 34L are inserted into the adjustment slots located at the furthest inward position 32R, 32L, the adjustable card pocket 100 is set to a minimum width setting. As shown in FIG. 3, when the adjustment tabs 34R, 34L are inserted into the adjustment slots located at the furthest outward position 28R, 28L, the adjustable card pocket 100 is set to a maximum width setting. An intermediate width setting is available when the adjustment tabs 34R, 34L are inserted in the adjustment slots located at an intermediate position 30R, 30L. The half pockets 12R, 12L are adjusted by grasping each half pocket and applying a slight outward pressure while either moving the half pockets in an inward or outward direction, depending on the desired width of the pocket. While the adjustment tabs 34R, 34L are being positioned within the adjustment slots, the pocket engagement tabs 24L, 26L are able to slide back and forth within the pocket engagement slots 20R, 20L, 22R, 22L. Each half card pocket 12R, 12L further contains two signage tabs 52L, 54L that extend horizontally outward about ½ inch from the side wall 46R, 46L and parallel to the back wall 44R, 44L. The signage tabs 52L, 54L are designed to engage signage placed along the back wall 44R, 44L of the half card pockets and the front side 14 of the back panel 10. The right 12R and left 12L half card pockets are made of a hard plastic material, although any suitable material that is strong enough to withstand the force of pressure applied for movement of the half pockets 12R, 12L between the adjustment slots of the back panel 10 can be used. Additionally, in a preferred embodiment, the half pockets 12R, 12L are transparent so that the entire greeting card is visible through the front walls 48R, 48L of the half pockets 12R, 12L. As shown in FIGS. 1 through 4, the front walls 48R, 48L of the half pockets 12R, 12L are arched, providing a barrier on the front side of the display so that the greeting cards will not fall out of the pocket while also minimally obstructing the face of the greeting cards. Also, the front 48R, 48L and side 46R, 46L walls are only approximately ⅔ the height of the back walls 44R, 44L, which are approximately the same height as the back panel 10.

Figure 5:
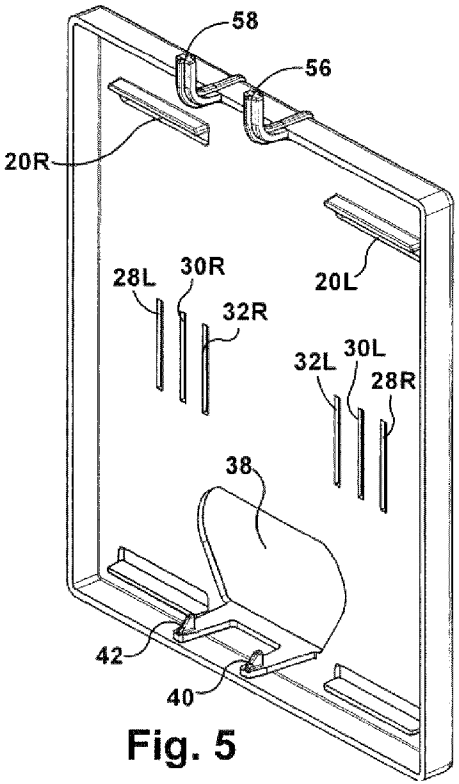
FIG. 5 is a perspective view of the back panel of the adjustable card pocket of FIG. 1.
Figure 4:
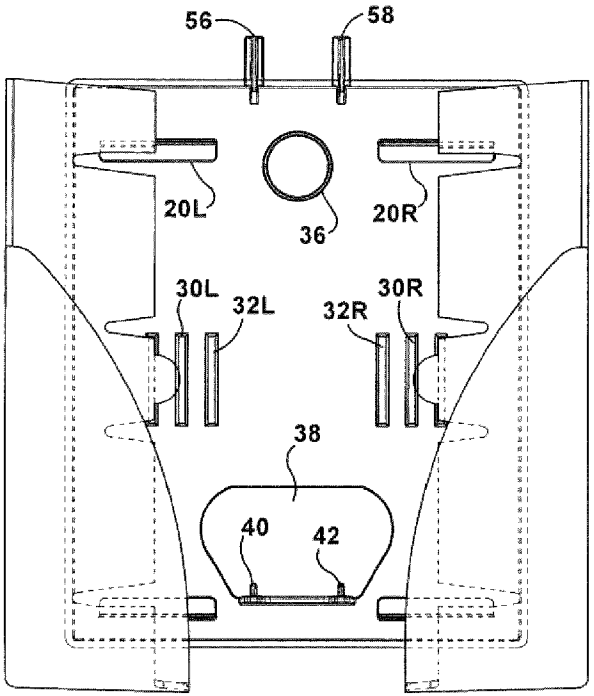
FIG. 4 is a front plan view of the adjustable card pocket of FIG. 1.
Figure 6:
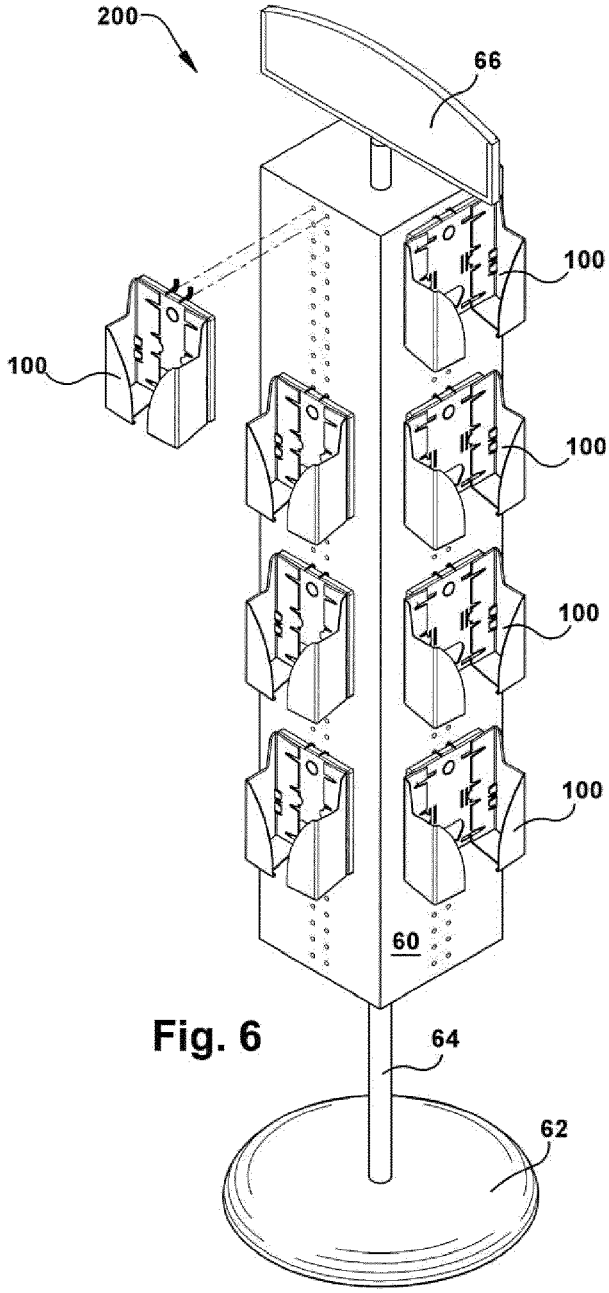
FIG. 6 is a perspective view several card pockets of the present invention attached to a card spinner display device.

Several adjustable card pockets 100 of the present invention can be mechanically attached to a mating panel 60, as described above. The mating panel 60, may be part of a rotatable card spinner 200 as is shown in FIG. 6, or part of any other accommodating retail display. The rotatable card spinner 200, as shown, contains four sides or mating panels 60 upon which adjustable card pockets can be placed, however, the card spinner 200 may contain any number of mating panels 60. The mating panel 60, as shown, contains a vertical series of two slots or openings which correspond to two upper panel engagement tabs 56, 58 located at and extending in an upward direction and at a 90 degree angle from the top side 16 of the back panel 10, as shown in FIG. 5. To attach the card pocket 100 to the mating panel 60, the card pocket 100 must be held in a horizontal position while inserting the two upper panel engagement tabs 56, 58 into the two slots or openings contain in the mating panel 60. Once the upper panel engagement tabs 56, 58 are inserted into the mating panel 60, the card pocket 100 may be returned to a vertical position and the lower panel engagement tabs 40, 42 inserted into two lower slots or openings upon the mating panel 60. The arrowhead-like tips secure the card pocket 100 to the mating panel 60. The card spinner 200 contains a spinner base 62, a mounting tube 64, a spinner hub (not shown) mating panels 60, cotter pins (not shown), thrust washers (not shown), thrust retainers (not shown) and a sign holder 66. The card spinner facilitates several adjustable card pockets 100 and allows for the easy and flexible display of a multitude of greeting cards.

It will be appreciated by persons skilled in the art that numerous variations and/or modifications may be made to the invention as shown in the specific embodiments without departing from the spirit or scope of the invention as broadly described. The present embodiments are, therefore, to be considered in all respect as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

The invention claimed is:

1. An adjustable card pocket comprising:

a back panel having interconnected sides including:

a front side;

a back side;

a top side;

a bottom side;

a right side;

a left side; and at least two upper panel engagement tabs;

at least two lower panel engagement tabs;

at least four pocket engagement slots;

at least six adjustment slots; and a release opening;

a right half card pocket having interconnected walls including:

a back wall;

a front wall;

a side wall; and a floor; and at least two pocket engagement tabs for mechanical and slidable engagement with two of the at least four pocket engagement slots of the back panel; and an adjustment tab for mechanical engagement with one of the at least six adjustment slots of the back panel, a left half card pocket having interconnected walls including:

a back wall;

a front wall;

a side wall; and a floor; and at least two pocket engagement tabs for mechanical and slidable engagement with two of the at least four pocket engagement slots of the back panel;

an adjustment tab far mechanical engagement with one of the at least six adjustment slots of the back panel;

wherein the back panel, the left half card packet and the right half card pocket together form an adjustable-width pocket for holding and displaying greeting cards and envelopes.

2. The adjustable card pocket of claim 1, wherein the back panel, right half card pocket and left half card packet are made of plastic.

3. The adjustable card pocket of claim 1, wherein the right half card pocket and left half card pocket are transparent.

4. The adjustable card pocket of claim 1, wherein the back panel is approximately 5.25 inches wide and 6.5 inches long.

5. The adjustable card pocket of claim 1, wherein the at least four pocket engagement slots on the back panel are approximately 1.31 inches wide.

6. The adjustable card pocket of claim 1, wherein the at least four pocket engagement slots are positioned horizontally on the back panel.

7. The adjustable card pocket of claim 1, wherein the at least six adjustment slots are positioned vertically on the back panel.

8. The adjustable card pocket of claim 1, wherein three adjustment slots are located on the right side of the back panel for mechanical engagement with the right half card pocket and three adjustment slots are located on the left side of the back panel for mechanical engagement with the left half card pocket.

9. The adjustable card pocket of claim 1 further comprising a circular ridge located on the back panel for the insertion of a decal indicating a category of greeting card to be placed within the pocket.

10. The adjustable card pocket of claim 1, wherein the at least two lower panel engagement tabs contain arrowhead-like tips at the ends for engagement with a mating panel.

11. The adjustable card pocket of claim 1, wherein the card pocket is attached to a greeting card spinner display device.

12. The adjustable card pocket of claim 1, wherein the angle between the back wall and the floor of the right and left half card pockets is slightly obtuse.

13. An adjustable card pocket comprising:

a back panel having a front side, a back side and a left, right, top and bottom side which extend in an outward direction away from the back panel, creating a channel on the back side of the back panel, the back panel also having left and right top pocket engagement slots, left and right bottom pocket engagement slots, at least six adjustment slots, and engagement means for attaching the adjustable card pocket to a mating panel or other compatible greeting card display fixture, a right half card pocket having a back wall, a front wall, a side wall, a floor, a top and bottom pocket engagement tab and an adjustment slot, the top and bottom pocket engagement tab and the adjustment slot extending outward in a backwards direction from the back wall of the right half card pocket;

a left half card pocket having a back wall, a front wall, a side wall, a floor, a top and bottom pocket engagement tab and an adjustment slot, the top and bottom pocket engagement tab and the adjustment slot extending outward in a backwards direction from the back wall of the left half card pocket, wherein the top pocket engagement tabs located on the right and left half card pockets are operatively engaged with the left and right top pocket engagement slots located on the back panel and the bottom pocket engagement tabs located on the right and left half card pockets are operatively engaged with the left and right bottom pocket engagement slots located on the back panel; and wherein each of the adjustment tabs located on the right and left half card pockets are operatively engaged with at least one adjustment slot located on the back panel.

14. The adjustable card pocket of claim 13, wherein the back panel, right half card pocket and left half card pocket are made of plastic.

15. The adjustable card pocket of claim 13, wherein the right half card pocket and left half card pocket are transparent.

16. The adjustable card pocket of claim 13, wherein the back panel is approximately 5.25 inches wide and 6.5 inches long.

17. The adjustable card pocket of claim 13, wherein the at least four pocket engagement slots on the back panel are approximately 1.31 inches wide.

18. The adjustable card pocket of claim 13, wherein the at least four pocket engagement slots are positioned horizontally on the back panel.

19. The adjustable card pocket of claim 13, wherein the at least six adjustment slots are positioned vertically on the back panel.

20. The adjustable card pocket of claim 13, wherein three adjustment slots are located on the right side of the back panel for mechanical engagement with the right half card pocket and three adjustment slots are located on the left side of the back panel for mechanical engagement with the left half card pocket.

21. The adjustable card pocket of claim 13 further comprising a circular ridge located on the back panel for the insertion of a decal indicating a category of greeting card to be placed within the pocket.

22. The adjustable card pocket of claim 13, wherein the at least two lower panel engagement tabs contain arrowhead-like tips at the ends for engagement with a mating panel.

23. The adjustable card pocket of claim 13, wherein the card pocket is attached to a greeting card spinner display device.

24. The adjustable card pocket of claim 13, wherein the angle between the back wall and the floor of the right and left half card pockets is slightly obtuse.

* * * * *